United States Patent [19]

Wood

[11] Patent Number: 4,666,228

[45] Date of Patent: May 19, 1987

[54] HERMETIC CONNECTOR AND METHOD

[75] Inventor: Walter D. Wood, Vandalia, Ohio

[73] Assignee: Pave Technology Co., Vandalia, Ohio

[21] Appl. No.: 536,937

[22] Filed: Sep. 28, 1983

[51] Int. Cl.[4] ..... H01R 4/00

[52] U.S. Cl. ..... 339/94 A; 339/126 RS; 29/876

[58] Field of Search ..... 339/94, 88 R, 88 C, 339/126 RS, 89 R, 89 C, 171, 218 R; 29/876

[56] References Cited

U.S. PATENT DOCUMENTS

| | | | |
|---|---|---|---|
| 2,610,222 | 9/1952 | Burtt et al. | 339/94 M |
| 3,070,649 | 12/1962 | Edlen et al. | 339/89 C |
| 3,341,930 | 9/1967 | Belanger | 29/401 |
| 3,475,808 | 11/1969 | Woolsey | 29/401 |
| 3,711,815 | 1/1973 | Pierce et al. | 339/94 M |
| 3,736,548 | 5/1973 | Double | 339/94 A |
| 3,997,230 | 12/1976 | Secretan | 339/94 M |
| 4,060,299 | 11/1977 | Williams | 339/94 R |
| 4,072,154 | 2/1978 | Anderson et al. | 339/94 C |
| 4,088,381 | 5/1978 | Harnett | 339/94 A |
| 4,334,730 | 6/1982 | Colwell et al. | 339/218 R |
| 4,426,124 | 1/1984 | Vandevier | 339/94 M |

FOREIGN PATENT DOCUMENTS

| | | | |
|---|---|---|---|
| 18916 | of 1910 | United Kingdom | 339/171 |

OTHER PUBLICATIONS

"Hermetically Sealed Wire Feedthru Harnesses & PAVE-Mate Connectors" brochure pub. by PAVE Technology Co., P.O. Box 416, Vandalia, OH 45377.

*Primary Examiner*—Gil Weidenfeld
*Assistant Examiner*—David L. Pirlot
*Attorney, Agent, or Firm*—Biebel, French & Nauman

[57] ABSTRACT

A hermetic connector comprising a housing adapted to attach to and extend through a wall of a sealed chamber and having an inner wall extending therethrough defining a passageway, and a removable connector body having an exterior surface matingly engaging the inner wall, ends thereof adapted to be connected to electrical equipment and joined together by wires, and O-rings mounted on the surface to form a hermetic seal between the inner wall and the exterior surface of the passageway. The O-rings are positioned on the exterior surface a distance from the ends of the connector body so that a first connector body may be displaced through the passageway and replaced therein by a second connector body such that the O-rings of at least one of the two bodies contacts the inner wall and forms a seal therewith at all times thereby maintaining a hermetic seal throughout the replacement process.

15 Claims, 7 Drawing Figures

HERMETIC CONNECTOR AND METHOD

BACKGROUND OF THE INVENTION

The present invention relates to electrical connectors and, more particularly to hermetically sealed electrical connectors adapted to be mounted on the wall of a sealed chamber. Hermetically sealed electrical connectors, also known as "electrical feedthrus", are used to connect electrical components located within a hermetically sealed chamber to complementary electrical components—which may include a power source—located outside of the chamber, and are mounted on a wall of the chamber such that gases and/or radiation within the chamber cannot escape through the connection between the connector and the wall.

Hermetic connectors may consist of a jam nut housing having a hex-shaped head, adapted to be grasped by a wrench, and a threaded shank of reduced diameter extending from the head, so as to form an annular flange. The housing is attached to the wall of a pressure vessel or other sealed container by inserting the threaded shank through a hole in the wall of approximately the same diameter, then threading a jam nut over the threaded shank to clamp the annular flange against the portion of the wall immediately surrounding the hole. To provide a hermetic seal between the housing and wall, the annular flange is provided with an O-ring, made of a flexible material such as silicone, which is deformed to seal the opening when the jam nut clamps the flange against the wall.

The center of the jam nut housing may contain a pair of receptacles, and these often are of the pin and socket type. The pins and sockets of the receptacles are connected in pairs by wires which are embedded in a body of solid epoxy, glass or ceramic which is bonded to and forms a hermetic seal with the wires, jam nut housing and receptacles. The receptacles also include a threaded collar or bayonet mount which is shaped to receive a matingly threaded collar of a plug, and an insert, preferably made of diayll phthalate, which serves as a matrix to support the pins and sockets. Typically, both the threaded collar and the insert are bonded to the epoxy core of the housing.

In another type of connector, lengths of insulated wires are embedded in the epoxy body so that their ends protrude from the housing. The ends of the wires can be connected to electrical components on both sides of the wall on which the housing is mounted.

A disadvantage with hermetic connectors such as these is that, to replace the receptacles or wires of a connector, it is necessary to replace the entire connector, which requires the breaking of the hermetic seal formed between the connector and the wall to which it is attached. For example, in order to substitute connector of the previously described type having a seven-pin receptacle for one with a six-pin receptacle, it is necessary to remove the jam nut from the threaded shank, withdraw the six-pin housing from the hole in the chamber wall, then insert the seven-pin housing through the hole and seal it to the wall by tightening down the jam nut on its shank.

However, it is known to provide a controlled environment chamber with a permanent housing that supports a replaceable inner member. For example, in Woolsey U.S. Pat. No. 3,475,808, a replaceable glove is disclosed which is adapted to be mounted on an annular port permanently fixed to the wall of a controlled environment chamber. The cuffs of both the original and replacement gloves are slipped over mounting rings and held thereon by O-rings, the mounting rings including set screws which engage grooves formed on the port.

To change gloves, the new glove is placed inside the original glove so that the mounting rings of the gloves abut each other within the port, but only the O-rings of the original mounting ring abut and make a seal with the port. A guide ring is slipped over the replacement mounting ring so that it is interposed between that ring and the port, the latter having an offset sized to compensate for the added thickness of the guide ring. A push ring is inserted through the guide ring and contacts the replacement mounting ring, pushing that ring to the location formerly occupied by the original mounting ring, and pushing the original mounting ring out of the port. The replacement ring is then attached to the port by set screws, and the guide and push rings removed.

A disadvantage with this type of device is that additional equipment is required to effect a replacement of gloves, thereby increasing the overall cost of the device. Furthermore, the system is designed to utilize the relatively narrow mounting rings and provides access to the inner surfaces of these rings for such operations as tightening set screws. Such components would be entirely inappropriate for use with hermetic connectors which are elongate and have solid interiors.

Accordingly, there is a need for an electrical connector in which the receptacles can be replaced without breaking the hermetic seal formed between the connector and associated wall, thereby enabling the receptacles to be replaced without danger of the exterior of the sealed chamber becoming contaminated by the contents of the interior of the chamber. In addition, such a connector should be relatively economical to manufacture and should be sized to be mounted in the same areas and through the same openings as the aforementioned prior art connectors.

SUMMARY OF THE INVENTION

The present invention is a hermetic connector which consists of a housing adapted to be attached to and extend through a wall of a sealed chamber and including a passageway extending therethrough, and a removable connector body shaped to fit within the passageway and having seals on its exterior surface which form a hermetic seal between the connector body and the housing. The connector body includes connector means at its ends joined together by wires, and a core of epoxy or other suitable material which is bonded to and makes a hermetic seal with the receptacles and wires.

The seals are spaced from the ends of the connector means such that a first one of the connector bodies may be displaced through the passageway and replaced therein by a second one of the bodies so that the seals of at least one of the connector bodies contacts the housing at all times. Thus, with the connector of the present invention, connector bodies having different types of receptacles may be substituted in the housing without having to remove the housing from the wall to which it is mounted, and without exposing the area surrounding the chamber to the contents of the chamber.

In a preferred embodiment, the connector means include receptacles, each having an outer, threaded portion and an end face having an electrical lead, such as the pin and socket type, positioned therein. The connector body is sized so that the threaded portions of the receptacles protrude beyond the passageway. In order to prevent rotation or sliding movement of the connector body relative to the housing, the housing includes a plurality of set screws which are positioned to be threaded radially inwardly to engage correspondingly positioned dimples or depressions in the exterior surface of the connector body. As an added measure, jam nuts can be threaded over the ends of the receptacles and against the ends of the housing.

Accordingly, it is an object of the present invention to provide a hermetic connector which can be fitted to the wall of a vessel relatively easily; a connector which can be adapted to receive quick-disconnect pin-and-socket type plugs; a connector in which a connector body having connector means at its ends may be replaced by a method which does not necessitate the removal of the connector housing from the vessel wall and does not break the hermetic seal between the connector and the wall; a connector which is of a relatively simple and inexpensive construction; and a method of replacing the connector body of such a connector which can be effected quickly and simply.

Other objects and advantages of the invention will be apparent from the following description, the accompanying drawings and the appended claims.

DETAILED DESCRIPTION OF THE PREFERRED EMBODIMENT

Figure 1:
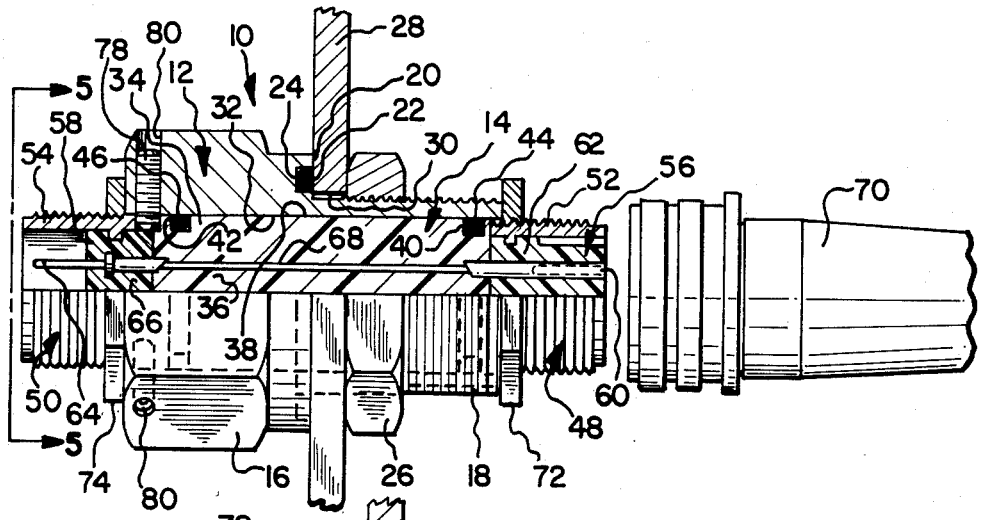
FIG. 1 is a side elevation in half-section of a preferred embodiment of the hermetic connector of the present invention, showing fragments of a quick-disconnect plug and a chamber wall on which it is mounted.
Figure 2:
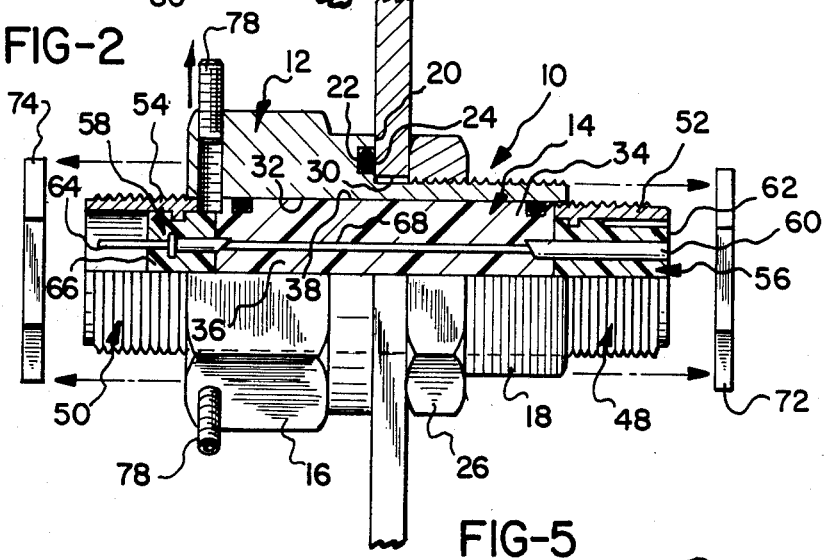
FIG. 2 is a side elevation in half-section of the connector of FIG. 1 in which the nuts have been removed from the receptacles and the set screws have been displaced outwardly.
Figure 5:
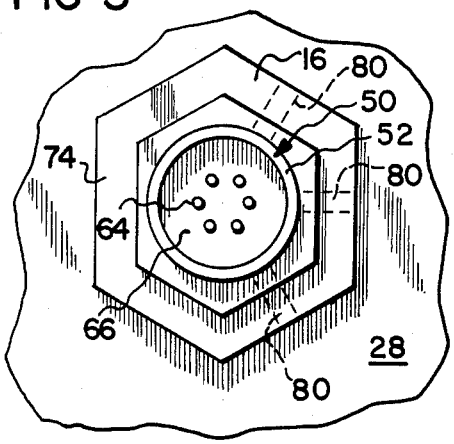
FIG. 5 is an end view of the connector of FIG. 1 taken at line 5—5 of FIG. 1.

As shown in FIGS. 1, 2 and 5, the hermetic connector of the present invention, generally designated 10, includes a housing 12 which supports a connector body 14. The housing 12 includes an enlarged hex-shaped head 16 and a threaded shank 18, having a diameter less than the head, which extends from the head to form an annular flange 20 therewith. The flange 20 includes an annular groove 22, spaced radially outwardly from shank 18, in which is seated an O-ring 24. A jam nut 26 is threaded onto shank 18.

Housing 12 is attached to the wall 28 of a vessel or other chamber by inserting shank 18 through an opening 30 having substantially the same diameter as the shank. Jam nut 26 is threaded over shank 18 and is tightened against wall 28, drawing flange 20 against the exterior surface of the wall. O-ring 24 is compressed, thereby forming a hermetic seal around the flange. In FIGS. 1–4, connector 10 is shown oriented so that the interior of the chamber is to the right of wall 28, and the exterior to the left. Thus, shank 18 is inserted through opening 30 into the interior of the chamber, and nut 26 is threaded on the shank.

Housing 12 includes a cylindrically-shaped inner wall 32 which forms a passageway 34 through head 16 and shank 18. Although passageway 34 is shown as being cylindrical, it is within the scope of the invention to provide a passageway having a different shape such as, for example, one that is square or oval in cross section. Connector body 14 includes a central core 36 which is substantially cylindrical in shape, having an exterior surface 38 of slightly less diameter than passageway 34 so that the connector bodies can be slid through the passageway. Exterior surface 38 includes a pair of annular grooves 40, 42 on which are mounted O-rings 44, 46, respectively. O-rings 44, 46 are sized to extend outwardly from grooves 40, 42 a distance sufficient to engage and form a hermetic seal with inner wall 32 of housing 12, and are spaced from each other a distance less than the length of passageway 34.

The ends of connector body 14 include as connector means receptacles 48, 50 which consist of threaded collars 52, 54, respectively, within which are located electrical leads 56, 58. Alternately, bayonet mounts can be used in place of the collars 56,58. Although a number of well-known leads may be employed, with receptacles 48, 50 shown in the figures lead 56 is a female lead which includes sockets 60 embedded in an insert 62, and lead 58 includes pins 64 embedded in an insert 66. Pins 64 and sockets 60 are joined in pairs by conducting wires 68 which extend through and are sealed in central core 36 of the connector body 14. Thus, a plug 70, having a shell of metal such as stainless steel or aluminum, and having pins (not shown) in the same configuration as the sockets 60, may be attached to receptacle 48. Similarly, a standard plug (not shown), which may be connected to a power source or a piece of equipment located outside of the chamber defined by wall 28 and having sockets corresponding to the pins 64, may be attached to receptacle 50. Both plugs preferably make a moisture-proof seal with the receptacles 40,50.

Connector body 14 is attached to housing 12 by mounting nuts 72, 74 which are threaded over collars 52, 54, respectively, and tightened against threaded shank 18 and head 16, respectively. By proper adjustment of nuts 72, 74, connector body 14 can be centered within the passageway 34. As shown in the figures, it is necessary that the length of connector body 14 exceed the length of passageway 34 so that receptacles 48, 50 protrude beyond the passageway sufficiently to expose threaded collars 52, 54. In order to fix connector body 14 to prevent rotation relative to housing 12, dimples or depressions 76 are formed on exterior surface 38 and are positioned to be engaged by set screws 78 which are threaded into radially extending holes 80 formed in head 16, as shown in FIGS. 1, 2, 3, and 5.

In the preferred embodiment, housing 12, including the jam nut 26, preferably is made of stainless steel, which is both strong and corrosion-resistant. O-rings 24, 42, 44 are made of silicone. The central core 36 of the connector body 14 is made of epoxy and is molded to provide a hermetic seal with the connecting wire 68, which preferably is made of copper. The collars 52, 54 and nuts 72, 74 preferably are made of anodized aluminum or stainless steel. Pins 64 and sockets 60 preferably are silver-plated copper and supporting inserts 62, 66 are made of diayll phthalate. Thus, connector 10 can be fabricated from well-known materials.

Figure 3:
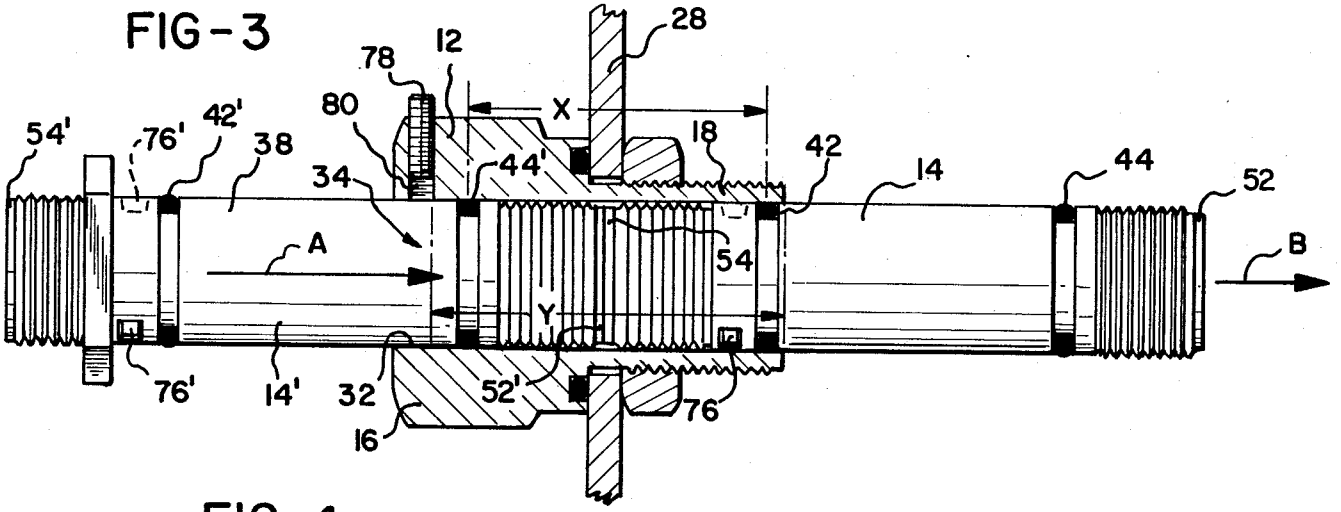
FIG. 3 is a side elevation of the connector of FIG. 1 in which a first connector body is being pushed through the housing by a second connector body, and in which the housing and vessel wall are in section.
Figure 4:
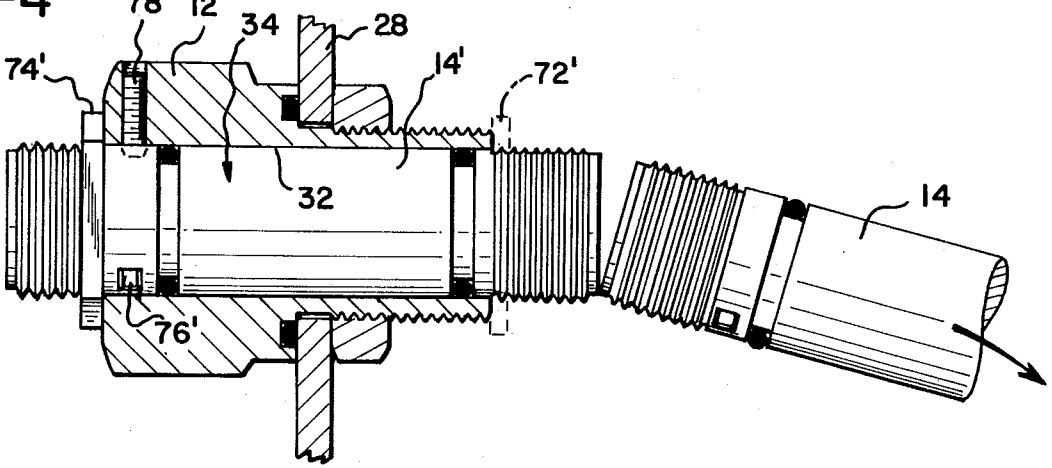
FIG. 4 is a side elevation of the connector of FIG. 3 in which the second connector body has pushed the first connector body from the housing.

The procedure for replacing connector body 14 with a second connector body 14' is shown sequentially in FIGS. 2, 3 and 4. As shown in FIG. 2, after the plugs have been removed from the receptacles 48,50, the mounting nuts 72, 74 are removed from the threaded collars 52, 54, respectively. This requires that a glove (not shown) attached to wall 28 be employed by the user to remove nut 72. Set screws 78 are then backed away from engagement with their corresponding depressions 76. The insert 14 is now free to be displaced relative to the housing 12, and, is slid through passageway 34 into the chamber sufficiently to allow end 52' of connector body 14' to be inserted into the outside end of the passageway.

As shown in FIG. 3, connector body 14', having nut 74' threaded on an end, is then displaced in the direction of arrow A toward threaded shank 18, pushing connector 14 out of passageway 34 in the direction of arrow B, with the end of threaded collar 52' of the connector body 14' abutting the end of threaded collar 54 of connector body 14 at this time. This is particularly important where there exists a vacuum inside the vessel; the pressure of nut 74' prevents the connector body 14' from being sucked into the chamber. As shown in FIG. 3, as threaded collars 52', 54 pass through the approximate midpoint of passageway 34, O-ring 42 is adjacent the end of threaded shank 18 and O-ring 44' of connector body 14' is well within the passageway. Further displacement in the direction of arrows A and B will cause O-ring 42 to clear the end of the threaded shank 18 and thus no longer provide a hermetic seal; however, O-ring 44' will be within the passageway 34 and provide a hermetic seal so that, during this procedure, no opening is made in the passageway 34 through which gas can escape.

The final stage of the substitution process is shown in FIG. 4 in which connector body 14 has been displaced completely from passageway 34 by connector body 14', and will drop within the chamber defined by wall 28. Connector body 14 can then be moved to a desired location within the chamber with the aforementioned glove. Connector body 14' is then attached to the housing 12 by tightening down mounting nut 72' and displacing set screws 78 inwardly to engage depressions 76'.

As shown in FIG. 3, in order for a hermetic seal to be maintained between connector bodies 14, 14' and inner wall 32 of the housing 12 at all times during the aforementioned replacement procedure, it is necessary that the distance between O-ring 42 of connector body 14 and O-ring 44' of connector body 14'—distance "X" in FIG. 3 —be less than distance "Y", the distance between the set screw hole 80 and the end of the shank 18 so that, during the aforementioned substitution procedure, gas will not be permitted to escape from the vessel. The outside bound of distance Y corresponds to the set screw hole 80 since an O-ring cannot make a seal at that point. In the preferred embodiment, the distance from each of the O-rings 42, 44, 42', 44' to their respective ends 54, 52, 54', 52' should be less than one-half distance "Y" so that, regardless of the orientation of connector bodies 14, 14' with respect to each other (for example if end 54' should be positioned to abut end 54), the hermetic seal will be maintained by an O-ring of at least one of the connectors at all times during a substitution procedure.

Figure 6:
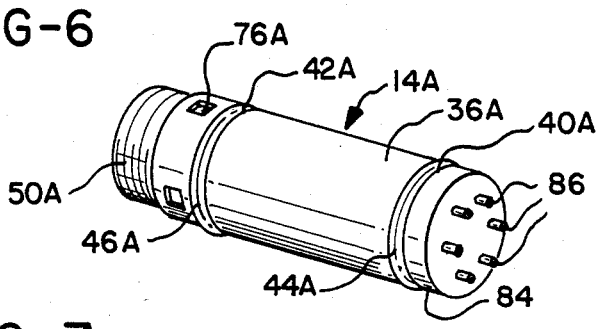
FIG. 6 is an alternate embodiment of a connector body of the hermetic connector of FIG. 1.

An alternate embodiment of a connector body 14A is shown in FIG. 6. The body 14A includes a central core 36A, grooves 40A, 42A, O-rings 44A, 46A and receptacle 50A, all of which are identical to their counterparts in the body 14 shown in FIGS. 1–5. However, body 14A includes as connector means at end 84 a plurality of solder cups 86 protruding outwardly therefrom. Solder cups 86, which are of conventional design, are bonded to and extend through the core 36A and are connected to the connector means (not shown) in receptacle 50A. The cups 86 are adapted to receive the base ends of wires (not shown) which may be connected to a plug or electrical equipment.

Figure 7:
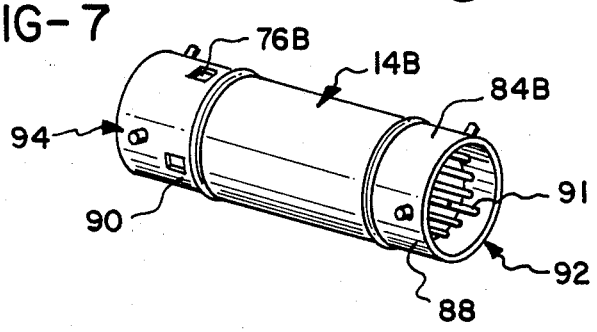
FIG. 7 is a second alternate embodiment of a connector body of the hermetic connector of FIG. 1.

Another type of body 14B is shown in FIG. 7, and is identical to the previously discussed connector bodies 14 and 14A except that, for connector means, it includes bayonet mounts 88,90. Bayonet mounts 88,90 include pin members 91 and socket members (not shown) in end faces 92,94 thereof, respectively, and in this respect end faces 92,94 are similar to receptacles 48,50 shown in FIGS. 1 and 2.

With each of the bodies 14A and 14B of FIGS. 6 and 7, the replacement procedures are the same as that outlined for body 14 and shown in FIGS. 2–4. Since the ends 84, 84B are not threaded and cannot receive jam nuts, the bodies 14A, 14B are held within the housing 12 (FIGS. 1–5) by set screws 78 which engage depressions 76A, 76B respectively.

While the form of apparatus herein described constitutes a preferred embodiment of this invention, it is to be understood that the invention is not limited to this precise form of apparatus, and that changes may be made therein without departing from the scope of the invention.

What is claimed is:

1. A hermetic connector comprising:

a housing adapted to attach to and extend through a wall of a sealed chamber, said housing having an inner wall extending therethrough defining a passageway;

a removable connector body having an exterior surface shaped to matingly and slidably engage said inner wall such that said body is displaceable through an entire length of said passageway, connector means at opposing ends thereof joined together by conductor means and adapted to be attached to electrical equipment positioned on either side of an associated chamber wall, and first and second seal means, each extending about a periphery of said body adjacent to a different one of said ends and extending outwardly from said exterior surface to engage said inner wall and form a hermetic seal therewith, said first and second seal means being spaced from said adjacent ends a distance such that substitution of a second one of said bodies for a first one of said bodies is effected by placing an end of said second body in abutting relation with an end of said first body and pushing said first body with said second body along and out of said passageway so that of said seal means of at least one of said bodies contacts said inner wall and forms a hermetic seal therewith at all times during said substitution; and means for attaching said connector body to said housing within said passageway.

2. The connector of claim 1 wherein said distance said first and second seal means are spaced from adjacent ones of said ends is less than one-half a length of said passageway.

3. The connector of claim 2 wherein each of said seal means includes a groove extending about a periphery of said body and spaced said distance from said adjacent one of said ends; and a resilient O-ring seated in said groove.

4. The connector of claim 3 wherein said rings of said first and second seal means are spaced apart a distance less than said length of said passageway.

5. The connector of claim 4 wherein said connector means includes solder cup means extending from one of said ends of said connector body.

6. The connector of claim 4 wherein said connector means includes bayonet mounts.

7. The connector of claim 4 wherein each of said connector means includes a receptacle having a threaded portion about a periphery thereof; and an end face having electrical lead means positioned therein.

8. The connector of claim 7 wherein said connector body has a length such that said receptacles protrude from said passageway when said body is centered therein.

9. The connector of claim 8 wherein said attaching means includes nut means threaded on said protruding receptacles.

10. The connector of claim 1 wherein said attaching means includes means for preventing rotation of said connector body relative to said housing.

11. The connector of claim 10 wherein said rotation preventing means comprises said exterior surface having depressions formed therein about a periphery of said connector body; and set screws threaded into said housing and positioned to engage said holes of said body when centered within said passageway, thereby preventing relative rotation and relative sliding movement therebetween.

12. The connector of claim 11 wherein said housing includes an enlarged head at an end thereof; a threaded shank at an opposite end thereof and joining said head to form a shoulder therewith; and a mounting nut threaded on said shank such that said shank may be inserted through an opening in a chamber wall and said mounting nut threaded on said shank to clamp an associated wall against said shoulder.

13. A hermetic connector comprising:

a housing adapted to be attached to and extend through a wall of a sealed chamber, said housing having an inner wall extending therethrough defining a substantially cylindrical passageway;

a connector body having a substantailly cylindrical exterior surface shaped to matingly and slidably engage said inner wall such that said body is displaceable through an entire length of said passageway, receptacles at opposing ends thereof, each having a threaded portion about a periphery thereof and an end face having electrical lead means positioned therein and adapted to be attached to a complementary plug, and first and second seal means, each including an annular groove extending about a periphery of said body adjacent one of said ends and a resilient ring seated in said groove and extending radially outwardly to engage said inner wall, said grooves being spaced from adjacent ones of said ends a distance less than one-half a length of said passageway such that substitution of a second one of said bodies for a first one of said bodies is effected by placing an end of said second body in abutting relation with an end of said first body and pushing said first body with said second body along and out of said passageway so that one of said seal means of at least one of said bodies contacts said inner wall at all times to form a hermetic seal therewith during said substitution, said body having a length such that said ends thereof protrude from said passageway when said body is centered therein;

means for attaching said connector body to said housing within said passageway including nut means threaded on said protruding ends; and means for preventing axial rotation of said body relative to said adapter means including a plurality of holes formed in said exterior surface and spaced about a periphery thereof, and a plurality of set screws, each threaded into said housing and oriented to be displaceable in a radial direction to selectively engage a corresponding one of said holes when said body is centered within said passageway.

14. A method of replacing a connector body of a hermetic connector having a housing attached to and extending through a wall of a sealed chamber, said housing having an inner wall extending therethrough defining a passageway, a first connector body having an exterior surface matingly engaging said inner wall, receptacles at ends thereof joined together by conductor means, seal means extending about a periphery of said first body and engaging said inner wall to form a hermetic seal therewith, and means for attaching said first body to said housing, comprising the steps of:

disengaging said attaching means from said first body such that said first body is slidable within said passageway;

placing a second one of said connector bodies in abutting relationship with said first body such that an inner one of said receptacles of said second body abuts an outer one of said receptacles of said first body;

urging said second body to slide within said passageway toward an interior of said chamber, thereby displacing said first body from said passageway inwardly to said chamber interior; and engaging said seal means of said second body with said inner wall to make a hermetic seal therewith, then breaking said hermetic seal between said seal means of said first body and said inner wall such that a hermetic seal exists between said inner wall and at least one of said connector bodies throughout said method.

15. The method of claim 14 further comprising the terminal step of engaging said attaching means to attach said second body to said housing.

* * * * *

UNITED STATES PATENT AND TRADEMARK OFFICE

CERTIFICATE OF CORRECTION

PATENT NO. : 4,666,228

DATED : May 19, 1987

INVENTOR(S) : Walter D. Wood

It is certified that error appears in the above-identified patent and that said Letters Patent is hereby corrected as shown below:

Column 6, line 63, after "that" insert --one--.

Signed and Sealed this

Third Day of November, 1987

*Attest:*

DONALD J. QUIGG

*Attesting Officer*

*Commissioner of Patents and Trademarks*